United States Patent [19]

Yanagisawa

[11] 3,945,340

[45] Mar. 23, 1976

[54] DEVICE FOR STRIKING A BELL

[75] Inventor: Takeshi Yanagisawa, Chiba, Japan

[73] Assignee: Kabushiki Kaisha Seikosha, Japan

[22] Filed: Nov. 18, 1974

[21] Appl. No.: 524,936

[30] Foreign Application Priority Data

Nov. 21, 1973 Japan ..... 48-134613[U]
Dec. 14, 1973 Japan ..... 48-139874[U]

[52] U.S. Cl. ..... 116/157; 116/167; 58/9; 58/21.12; 84/406

[51] Int. Cl.[2] ..... G10K 1/065

[58] Field of Search ..... 116/167, 163, 161, 160, 116/157, 155, 152, 148, 156, 91; 58/38 A, 9, 21.12; 84/406, 407, 103

[56] References Cited

UNITED STATES PATENTS 3,529,567 9/1970 Storm et al. ..... 116/167

*Primary Examiner*—Richard C. Queisser
*Assistant Examiner*—Marcus S. Rasco
*Attorney, Agent, or Firm*—Robert E. Burns; Emmanuel J. Lobato; Bruce L. Adams

[57] ABSTRACT

A device for striking a bell comprises a hammer head having a head portion composed of hard material and another head portion composed of soft material to obtain both hard and soft sounding bell rings. The hammer head is connected to a rockable striking hammer lever which is driven with a rocking motion by a rotating eccentric cam to cause the hammer head to strike the bell. The center of rocking motion of the striking hammer lever can be shifted both manually and automatically to selectively vary the hardness and softness of the bell ring.

8 Claims, 14 Drawing Figures

DEVICE FOR STRIKING A BELL

The present invention relates to device for striking a bell employed in a clock or the like.

In a conventional bell striking device, in order to change the striking sound from soft to hard, a thin leather strip, plastic sheet or the like is inserted between a hammer head and a bell. However it is very unsteady in operation to move such a thin material, and the structure becomes unduly complex.

The present invention intends to eliminate the conventional defects and provide a bell striking device which makes it possible to change the bell sound with ease.

One object of the present invention is to make it possible to change the bell sound from soft to hard and vice versa by shifting the center of rocking motion of the striking hammer lever.

Another object of the present invention is to change the bell sound automatically.

According to one feature of the present invention there is provided a device for striking a bell comprising a rockable striking hammer lever, a driving means for rocking said striking hammer lever including a motor and an eccentric cam secured to a driving shaft of said motor, a hammer head connected to the end portion of said striking hammer head, and a bell disposed to be struck by said striking hammer head.

Figure 1:
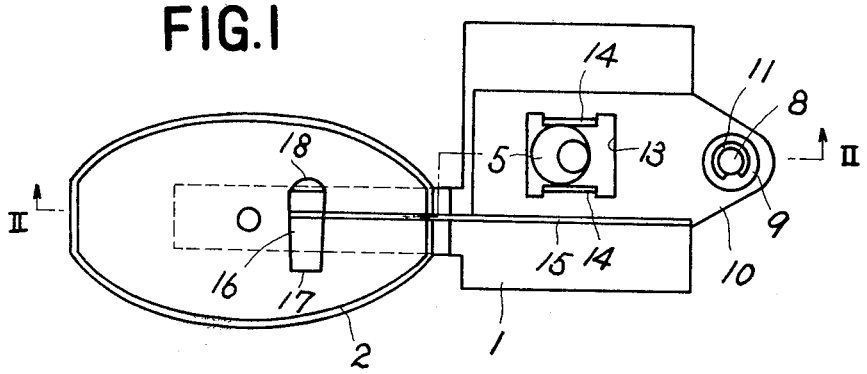
Figure 2:
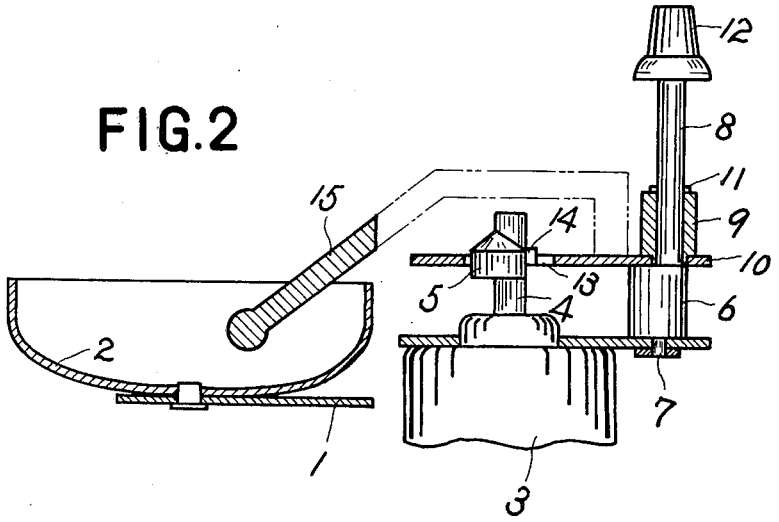
Figure 3:
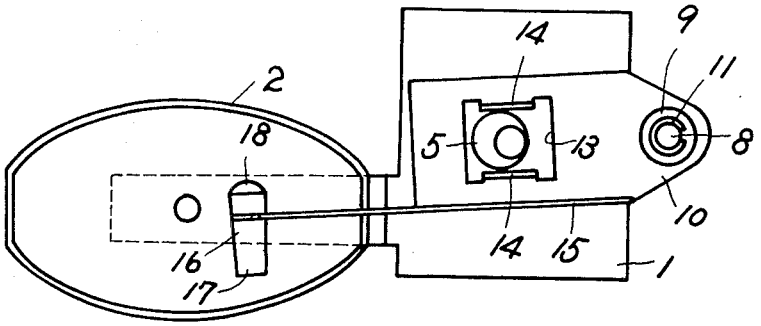
Figure 4:
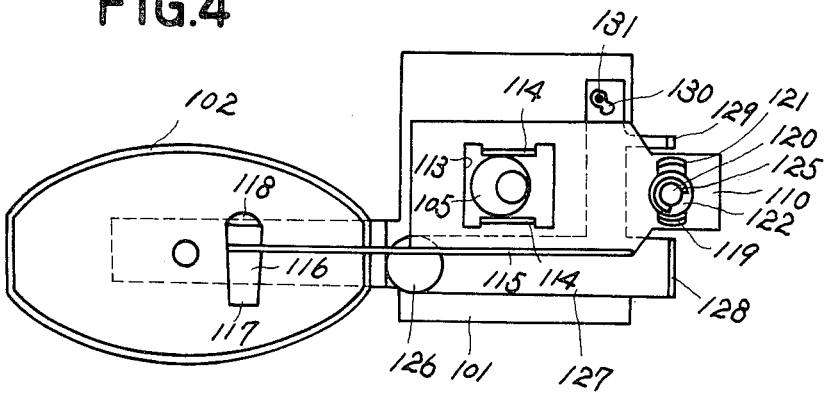
Figure 5:
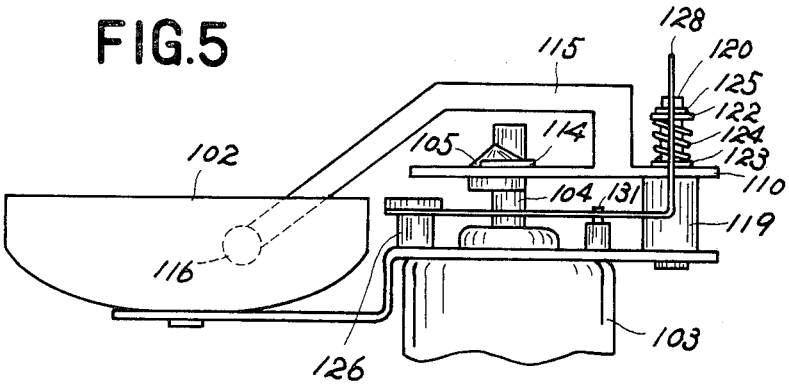
Figure 6:
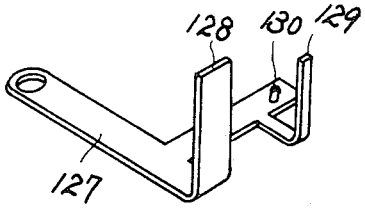
Figure 7:
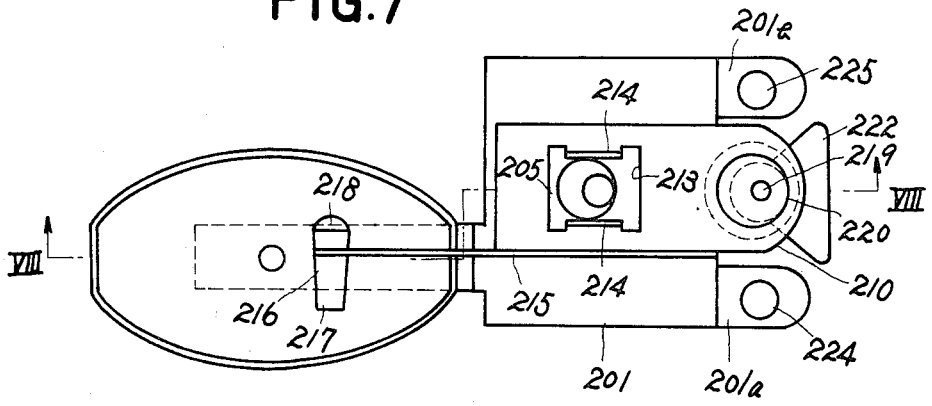
Figure 8:
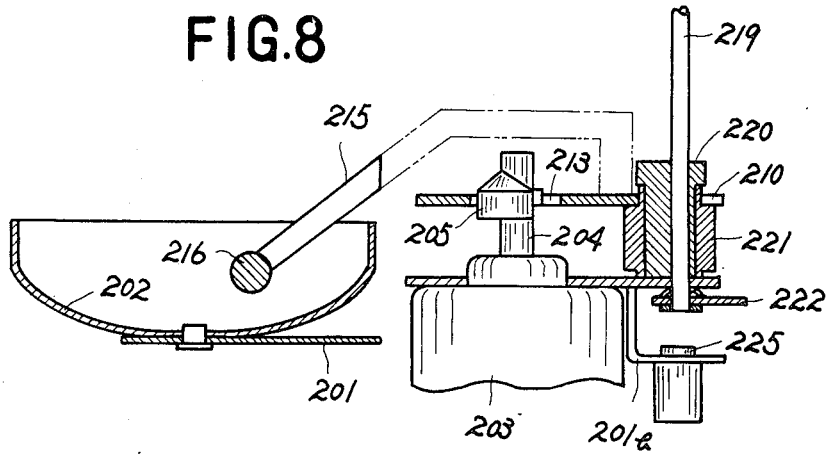
Figure 9:
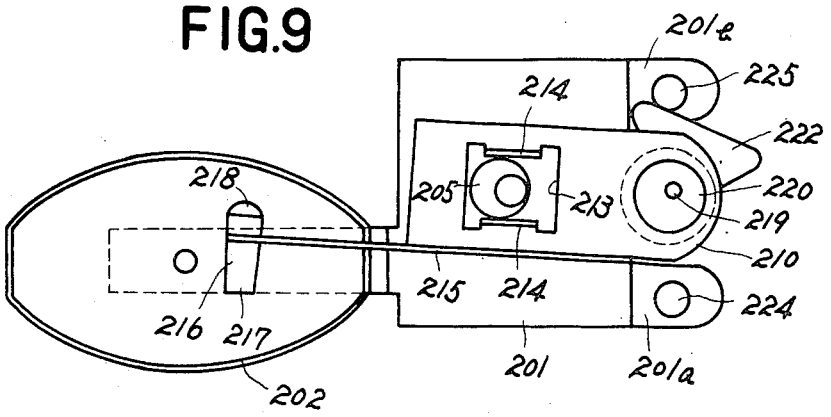
Figure 10:
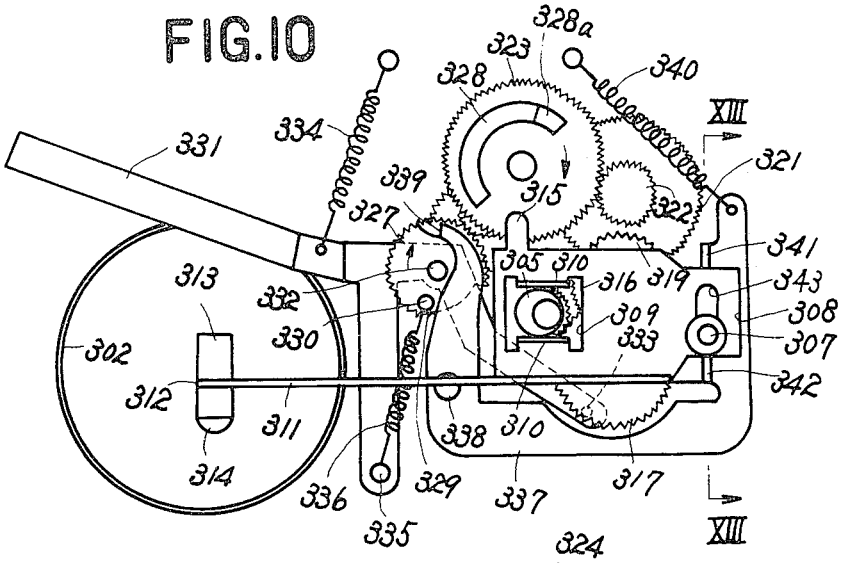
Figure 11:
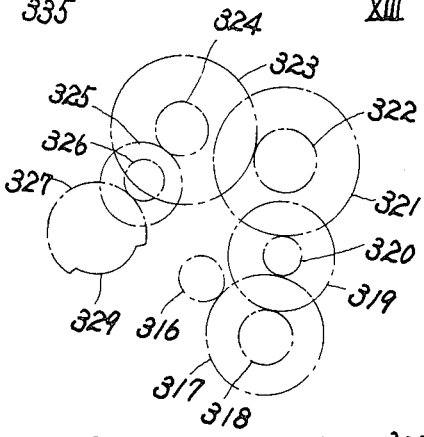
Figure 12:
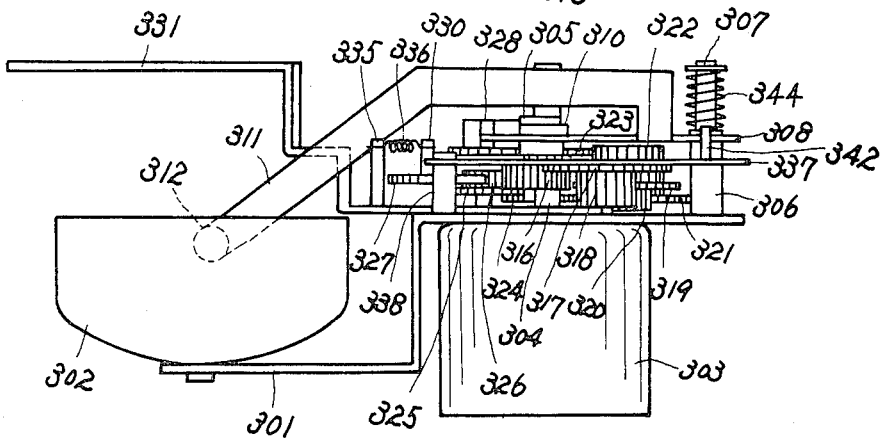
Figure 13:
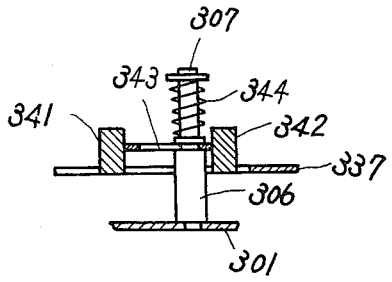
Figure 14:
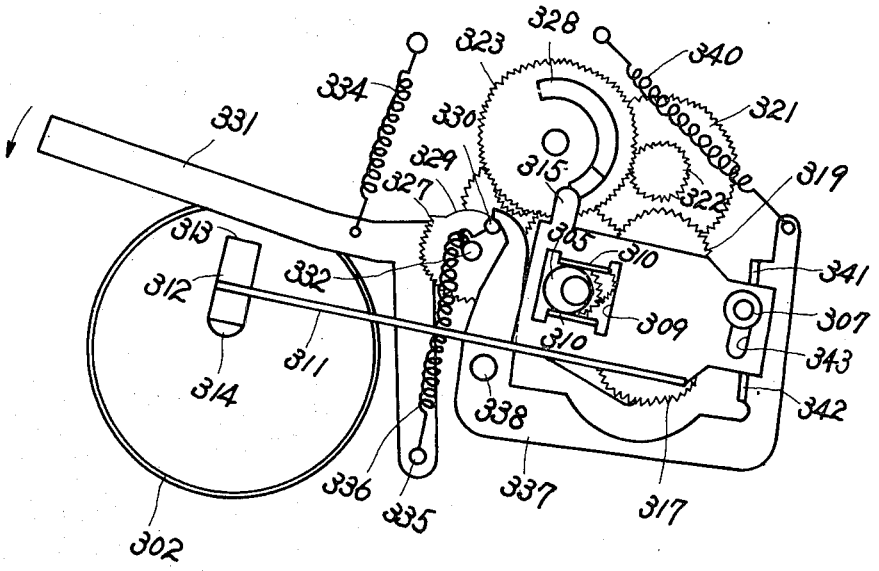

These objects as well as other objects and characteristic features of the present invention will become evident and will be more readily understood from the following description and claims taken in conjunction with the following drawings, in which, FIG. 1 is a plan view of one embodiment of the present invention, FIG. 2 is a section along lines II—II in FIG. 1, FIG. 3 is a plan view of the embodiment of FIG. 1 showing another state, FIG. 4 is a plan view of another embodiment, FIG. 5 is an elevational view of the embodiment of FIG. 4, FIG. 6 is a perspective view of a change lever, FIG. 7 is a plan view of still another embodiment, FIG. 8 is a section along lines VIII—VIII in FIG. 7, FIG. 9 is a plan view of the embodiment of FIG. 7 showing another state, FIG. 10 is a plan view of still another embodiment of the present invention, FIG. 11 is a explanatory view for showing gear train of the embodiment of FIG. 10, FIG. 12 is a side view of the embodiment of FIG. 10, FIG. 13 is a section along lines XIII—XIII in FIG. 10, and, FIG. 14 is a explanatory plan view of the embodiment of FIG. 10.

Refering now to FIGS. 1 to 3, one embodiment of the present invention will be explained.

To one portion of a base plate 1, a bell 2 is connected, and to the other portion of the base plate a motor 3 is fixed. To a driving shaft 4 of the motor, a cylindric eccentric cam 5 is connected. A crank 6 is rotatably supported by the base plate 1. A crank pin 7 protrudes from and is rotatably supported by the base plate 1, whereas a crank shaft 8 eccentrically protrude upwards. A washer 9 is rotatably secured about the crank shaft 8, and a rockable plate 10 is connected to the washer 9. The washer 9 is restrained from axial movement by a stop ring 11. To the top end of the crank shaft 8, a button 12 is secured. In the rockable plate 10, a square shaped cutout 13 is provided. On both sides of the cutout 13, cam followers in the form of risings 14, 14 are formed. Between the risings 14, 14 is positioned the eccentric cam 5. A striking hammer lever 15 is provided integrally with the rockable plate 10, and a hammer head 16 is connected to its end portion. One head portion 17 of the hammer head 16 is made of hard material such as metal, whereas the other head portion 18 is made of soft material such as rubber, synthetic resin or the like. The hammer head 16 is positioned so as to strike the inside of the bell 2 at a right angle thereto.

In operation and with the parts in the position shown in FIG. 1, when the motor 3 operates, the eccentric cam 5 rotates alternately pushing the risings 14, 14 and thus the rockable plate 10 rocks about the crank shaft 8. The striking hammer lever 15 also rocks and the hammer head 16 alternately strikes opposite sides of the bell 2 with head portions 17, 18 thereby producing alternate hard and soft rings. The bell sound can be changed by rotating the button 12. If the button 12 is rotated in the counterclockwise direction, as shown in FIG. 3, the crank shaft 8 also rotates with it, and the center of rocking motion of the rockable plate 10 accordingly shifts so that the hammer head position 17 comes nearer to the bell 2 thereby producing hard bell sound. When the button 12 is rotated in the reverse direction, the hammer head portion 18 comes nearer to the bell 2 and the bell sound becomes softer. When the hammer head 16 is positioned at the center of the bell 2, both the hard sound and the soft sound may be produced.

Refering FIGS. 4 to 6, another embodiment will be explained.

In the drawings, parts corresponding to similar parts in the embodiment of FIGS. 1 to 3 are given similar numerals increased by 100.

To the base plate 101, a pillar 119 is connected, and a shaft 120 is integral with the pillar 119 extends upward. This shaft 120 penetrates a slit 121 provided in a rockable plate 110. Rings 122, 123 are provided about the shaft 120 and a coil spring 124 is supported about the shaft between the rings 122 and 123. A washer 125 is secured to the upper portion of the shaft 120 such that the spring 124 is compressed slightly with the spring force applied to the rockable plate 110. A shaft 126 is fixed on the base plate 101. A change lever 127 for shifting the center of rocking motion of the rockable plate 110 is rotatable about the shaft 126. The change lever 127 is provided with two risings 128, 129 and a gourd-shaped guide hole 130 having two enlarged portions as shown in FIG. 6. A pin 131 provided on the base plate 101 slidably engages with the hole 130.

In operation, to change the bell sound, the rising 128 of the change lever 127 is manually pushed in one direction thereby turning the lever about the shaft 126. The pin 131 engages with the other enlarged portion of the hole 130. The rockable plate 110 is rotated by the change lever 127 thereby shifting the center of rocking motion of the rockable plate. Thus the striking hammer lever is rotated and the hammer head 116 nearer the bell. Therefor the bell sound changes from hard to soft and vice versa.

Refering FIGS. 7 to 9, still another embodiment of the present invention will be explained.

In the drawings, parts corresponding to similar parts in the embodiment of FIGS. 1 to 3 are given similar reference numerals increased by 200.

A shaft 219 is rotatably supported by a base plate 201. A pillar shaped eccentric cam 220 is connected to the shaft 219. A washer 221 is rotatable about the cam 220. A rockable plate 210 is connected to the washer 221. A triangular detent 222 is connected to the lower end portion of the shaft 219. A spring washer 223 is provided between the detent 222 and the base plate 201. The base plate 201 is secured to a case (not shown in the drawings) at its legs 201*a*, 201*b* by screws 224, 225. The legs 201*a*, 201*b* define the rotation of the detent 222.

In operation, when the striking hammer lever 215 is in the state of FIG. 7, the hammer head 216 does not strike the bell 202 even if the motor 203 is actuated and the hammer lever is rocked. When the shaft 219 is rotated in a counterclockwise direction until the detent 222 comes into contact with the leg 201*a*, the eccentric cam 220 is rotated and the washer 221 is also eccentrically rotated so that the center of rocking motion of the rockable lever 210 shifts as shown in FIG. 9. The striking hammer lever 215 is rotated clockwise, and the head portion 218 of the hammer head 216 is positioned near the bell 202. If the motor 203 operates under this condition, the hammer head 216 strikes the bell 202 only with the head portion 218. Therefore the bell sound is soft. In order to change the bell sound from soft to hard, the shaft 219 is rotated in the reverse direction.

Refering to FIGS. 10 to 14, an embodiment of the present invention in which the bell sound is automatically changed will be explained. A bell 302 and a motor 303 are secured to a base plate 301. The driving shaft 304 of the motor 303 projects through the base plate 301, and a motor pinion 316 and an eccentric cam 305 are respectively secured to the shaft 304. A pillar 306 is connected and a shaft 307 integral with the pillar extends upward. The shaft 307 extends through a slit 343 provided in a rockable plate 308. The rockable plate 308 is pushed downward by a coil spring 344. A square shaped cutout 309 is provided in the rockable plate 308. Rising projections 310, 310 are formed on both sides of the cutout 309. Between the rising projections 310, 310, the eccentric cam 305. A striking hammer lever 311 is provided integrally with the rockable plate 308, and a hammer head 312 is connected to its end portion. One head portion 313 of the hammer head 312 is made of hard material such as metal, whereas the other head portion 314 is made of soft material such as rubber, synthetic resin or the like. The hammer head 312 is positioned so as to strike the inside surface of the bell 302 at a right angle thereto.

The rockable plate 308 is provided with a sliding piece 315. The rotation of the motor pinion 316 is transmitted to a sound change gear wheel 327 through deceleration gear train consisting of a gear wheel 317, a pinion 318, a gear wheel 319, a pinion 320, a gear wheel 321, a pinion 322, a sound intermitting gear wheel 323, a pinion 324, a gear wheel 325 and a pinion 326. The sound intermitting gear wheel 323 is provided with a projection 328 having a slope 328*a* descending in the clockwise direction in FIG. 10. The sound change gear wheel 327 is provided with a toothless portion 329 at its outer periphery, and a pin 330 on its upper surface. The sound intermitting gear wheel 323 is rotatably supported by a shaft 332 fixed on an alarm stop lever 331.

The alarm stop lever 331 is rockably supported by a pin 333 mounted on the base plate 301 and is pulled in the clockwise direction in FIG. 10 by a coil spring 334. A coil spring 336 is hitched between a pin 335 standing on the lever 331 and the pin 330 on the sound change gear wheel 327. A sound change lever 337 is rotatably supported by a shaft 338 fixed on a base plate 301. The sound change lever 337 rocks clockwise when it is pushed at its end portion 339 by the pin 330 and the sound change lever 337 is pulled counterclockwise by a coil spring 340. The sound change lever 337 is provided with two projections 341, 342 standing on both sides of the rockable plate 308 as shown in FIG. 13.

The operation of the embodiment shown in FIGS. 10–14 will now be explained.

At an alarm set time, the motor 303 starts rotation. The eccentric cam 305 also rotates to rock the rockable plate 308 together with the striking hammer lever 311. Thus the hammer head 312 begins striking the bell 302. Under the state of FIG. 10, the hammer head 312 strikes the bell 302 at its head portion 314 producing a soft alarm sound. In proportion to the rotation of the motor pinion 316, the sound intermitting gear wheel 323 rotates through the deceleration gear train. When the projection 328 slidably pushes up the sliding piece 315, the rising projections 310, 310 are disengaged from the eccentric cam 305 and the alarm is interrupted. As the sound intermitting gear wheel 323 further rotates, the sliding piece 315 is disengaged from the projection 328 and the hammer head 312 begins striking the bell 302 to produce bell sound. In this manner, the bell 302 rings intermittently.

As the motor pinion 316 rotates, the sound change gear wheel 327 rotates in the direction shown in FIG. 10 and the pin 330 gradually pushes the end portion 339 of the sound change lever 337 to turn the sound change lever against the spring force of the coil spring 340. The projection 341 turns the rockable plate 308 in the counterclockwise direction. The head portion 313 approaches the bell 302 and the bell sound becomes gradually harder. Thus the bell 302 rings intermittently and the bell sound gradually changes from soft to hard. When the sound change gear wheel 327 is rotated to the position where the toothless part 329 is engaged with the pinion 326 as shown in FIG. 14, the sound change gear wheel can not rotate any more. Therefore the bell continues ringing in the hard sound mode in an intermittent manner.

In order to stop alarm, the alarm stop lever 331 is pushed in the direction as shown by an arrow in FIG. 14. At the same time the motor 302 is stopped. The alarm stop lever 331 is turned counterclockwise about the pin 333. Since the sound change gear wheel 327 is moved by the alarm stop lever 331, it is disengaged from the pinion 326. The sound change gear wheel 327 is restored to its home postion shown in FIG. 10 by the force of the coil spring 336 and the sound change lever 337 is released from the pin 330 and is restored to its home position.

What we claim is:

1. Device for striking a bell comprising:

a base plate, a rockable striking hammer lever rockably mounted on said base plate, driving means for driving said striking hammer lever with a rocking motion including a motor and an eccentric cam secured to a driving shaft of said motor, a hammer head connected to the end portion of said striking hammer lever, and a bell positioned relative to said hammer head to be struck by said hammer head during rocking motion of said striking hammer lever.

2. Device for striking a bell according to claim 1 including means for shifting the center of rocking motion of said striking hammer lever.

3. Device for striking a bell according to claim 2 in which one head portion of said hammer head is made of hard material and the other head portion is made of soft material.

4. Device for striking a bell according to claim 3 in which said means for shifting the center of rocking motion of said striking hammer lever includes a rotatable crank coacting with said striking hammer lever to shift the center of rocking motion thereof in response to turning of said crank.

5. Device for striking a bell according to claim 3 further comprising a shaft connected to said base plate, means defining a slit located at the center portion of rocking motion of said striking hammer lever, said slit being slidably engaged with said shaft, and a manually operative change lever rotatably supported on said base plate for enabling manual turning said striking hammer lever.

6. Device for striking a bell according to claim 3 further comprising a shaft connected to said base plate, means defining a slit located at the center portion of rocking motion of said striking hammer lever, said slit being slidably engaged with said shaft, a change lever rotatably supported on said base plate for effecting turning of said striking hammer lever, and a pin mounted on a gear wheel driven by said motor through a deceleration gear train so that said change lever shifts the center of rocking motion of said striking hammer lever in response to turning of said pin.

7. Device for striking a bell according to claim 6 wherein said gear wheel is rotatably supported on an alarm stop lever, and said gear wheel is provided with a toothless portion to limit its rotation for keeping in place the shifted center of rocking motion of said striking hammer lever.

8. Device for striking a bell according to claim 7 further comprising a hitch spring connected between said pin and a pin connected on said alarm stop lever so that as said alarm stop lever is turned, said gear wheel becomes disengaged from said deceleration gear train thereby releasing said change lever and restoring said striking hammer lever to its initial position.

* * * * *